US006053788A

United States Patent [19]

Garofalo

[11] Patent Number: 6,053,788

[45] Date of Patent: Apr. 25, 2000

[54] SWIMMING FLIPPER

[75] Inventor: Giovanni Garofalo, Rapallo, Italy

[73] Assignee: HTM Sport S.p.A., Italy

[21] Appl. No.: 09/133,808

[22] Filed: Aug. 13, 1998

[30] Foreign Application Priority Data

Sep. 12, 1997 [IT] Italy ..... GE970031 U

[51] Int. Cl.[7] ..... A63B 31/08

[52] U.S. Cl. ..... 441/64

[58] Field of Search ..... 441/61, 64

[56] References Cited

U.S. PATENT DOCUMENTS

| | | | |
|---|---|---|---|
| 3,649,979 | 3/1972 | MacNiel . | |
| 3,810,269 | 5/1974 | Tabata et al. . | |
| 5,702,277 | 12/1997 | Wagner | 441/64 |

FOREIGN PATENT DOCUMENTS

| | | |
|---|---|---|
| 0 572 853 | 12/1993 | European Pat. Off. . |
| 0 607 568 | 7/1994 | European Pat. Off. . |
| 0 640 361 | 3/1995 | European Pat. Off. . |
| 0 685 242 | 12/1995 | European Pat. Off. . |
| 1296314 | 11/1962 | France . |
| 2 550 456 | 2/1985 | France . |
| 95/24242 | 9/1995 | WIPO . |

*Primary Examiner*—Stephen Avila
*Attorney, Agent, or Firm*—Larson & Taylor

[57] ABSTRACT

A swimming flipper of the kind equipped with a blade, on which a shoe-shaped part (open or closed) is moulded, and the blade stretches itself towards the back so as to form a portion of the sole of the shoe-shaped part. Ribbings are obtained during the moulding phase of the shoe-shaped part with the same material as the shoe-shaped part, thus allowing the use of a relatively stiff material for the blade.

4 Claims, 3 Drawing Sheets

SWIMMING FLIPPER

BACKGROUND OF THE INVENTION

The present invention relates to a swimming flipper of the kind provided with a blade made of a relatively stiff material, on which a shoe-shaped member (open or closed) made of a softer elastomeric material is moulded. In particular, the invention relates to a flipper of this kind, the blade of which is provided with a part extending itself towards the back so as to form a part of the sole of the shoe member.

Generally speaking, in this kind of flipper the blade is sidewise provided with two broad ribbings whose function is both to convey the water flow during the swimming and to anchor firmly the blade part to the shoe. In order to achieve the best performances while swimming with flippers, it would be advisable to have a "springy" blade, which can be obtained with a relatively stiff and thin material. However, it is not possible to use such a stiff blade in the flippers described above, since the two lateral ribbings would make the bending practically impossible for the blade. Therefore, in these flippers a compromise is usually reached, according to which a relatively soft plastic material is used for the blade part.

SUMMARY OF THE INVENTION

According to a main feature of the invention, the ribbings are eliminated from the blade, said ribbings, on the contrary, being formed during the moulding step of the shoe with the same material as the shoe, thus obtaining the advantage of manufacturing a flipper with a very springy blade, and entrusting some ribbings of an elastic material with the task of conveying the water flow moved during the swimming.

According to another feature of the invention, the sole part of the blade of the said flipper extends itself sidewise upwards so as to partially wrap the sides of the shoe-shaped part, thus ensuring a better position of the foot in the shoe.

According to a still further feature of the invention, two nozzle-like elements are formed near the front rim of the blade.

Finally, the connection of the blade and of the shoe-shaped part in the sole takes place gradually with substantially V-shaped profile in top-plane view.

BRIEF DESCRIPTION OF THE DRAWINGS

The invention will now be described with more details with reference to the enclosed drawings, wherein.

DESCRIPTION OF THE PREFERRED EMBODIMENT OF THE INVENTION

Figure 1:
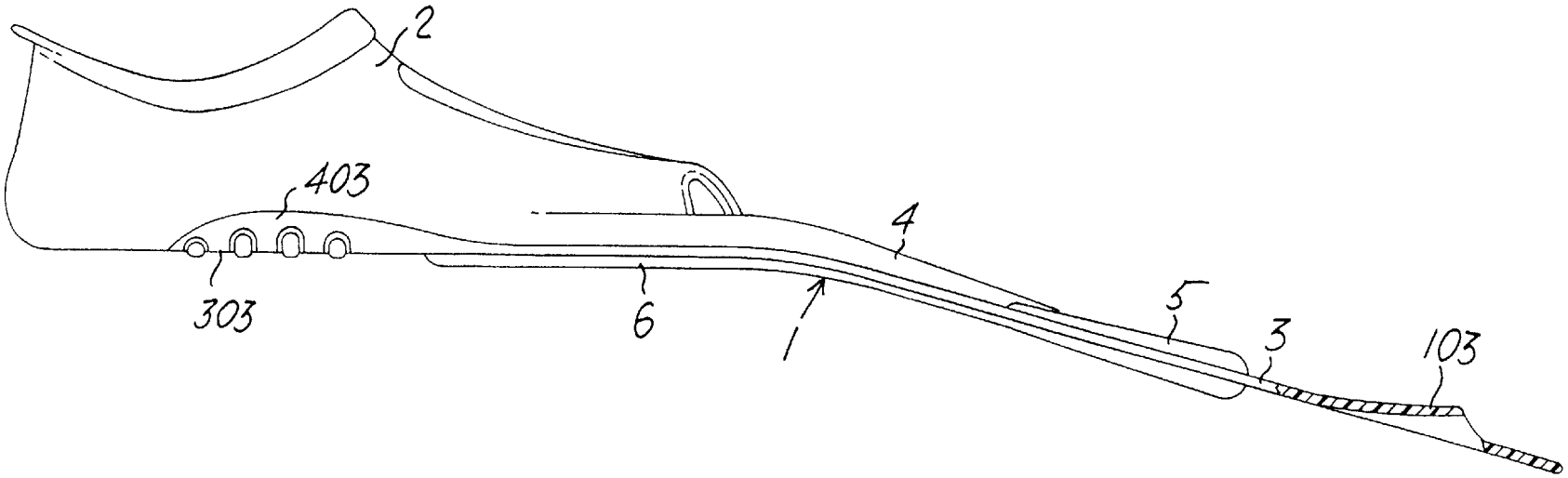
FIG. 1 is a view in side elevation, partially sectioned, of a flipper according to the present invention.

In FIG. 1 it is possible to see a flipper 1 having a shoe-shaped portion 2 made of a soft elastomeric material and a blade 3 made of a relatively stiff and "springy" material. It can be easily observed that said flipper does not show the usual lateral ribbings, but the longitudinal reinforcement is made up of two pairs of ribbings 4 and 5, which are present on the upper surface of the blade, and of a pair 6 which is present on the lower surface. Such ribbings are smaller than the usual ones: in fact, they have a limited height and do not follow the blade the whole of its length. Moreover, the ribbings 4 are not placed on the rim of the blade, but are distanced from such rim for a space which grows larger the farther it goes from the shoe-shaped part. These ribbings are made of the same material as the shoe-shaped part and are moulded together with it onto the blade. It is evident that the aim of the ribbings 4, 5, 6 is not that of stiffening the blade, since the latter is already made of a material stiff enough.

The end 303 of the blade 3, such end forming a part of the sole of the shoe 2, bends laterally upwards in 403 to give higher lateral stiffness to the shoe-shaped part 2, and in fact, as the lateral ribbings are not present, the foot might be insufficiently sealed on the sides.

On the front end of the blade two nozzle elements 103 have been obtained (one of them can be seen in section in FIG. 1). As can be observe in FIG. 2, the nozzles 103 are positioned on the rim of the blade 3. These nozzles, together with the ribbings 4, 5, 6, convey the flow during the swimming. Differently from the ribbings, the nozzles 103 are not made of a soft elastomeric material, but they are manufactured as one piece with the blade 3. Moreover, given the shape of these nozzles, they can be used as holes through which two hooks can pass in order to hang the flipper and show it, for instance in a shop.

Figure 2:
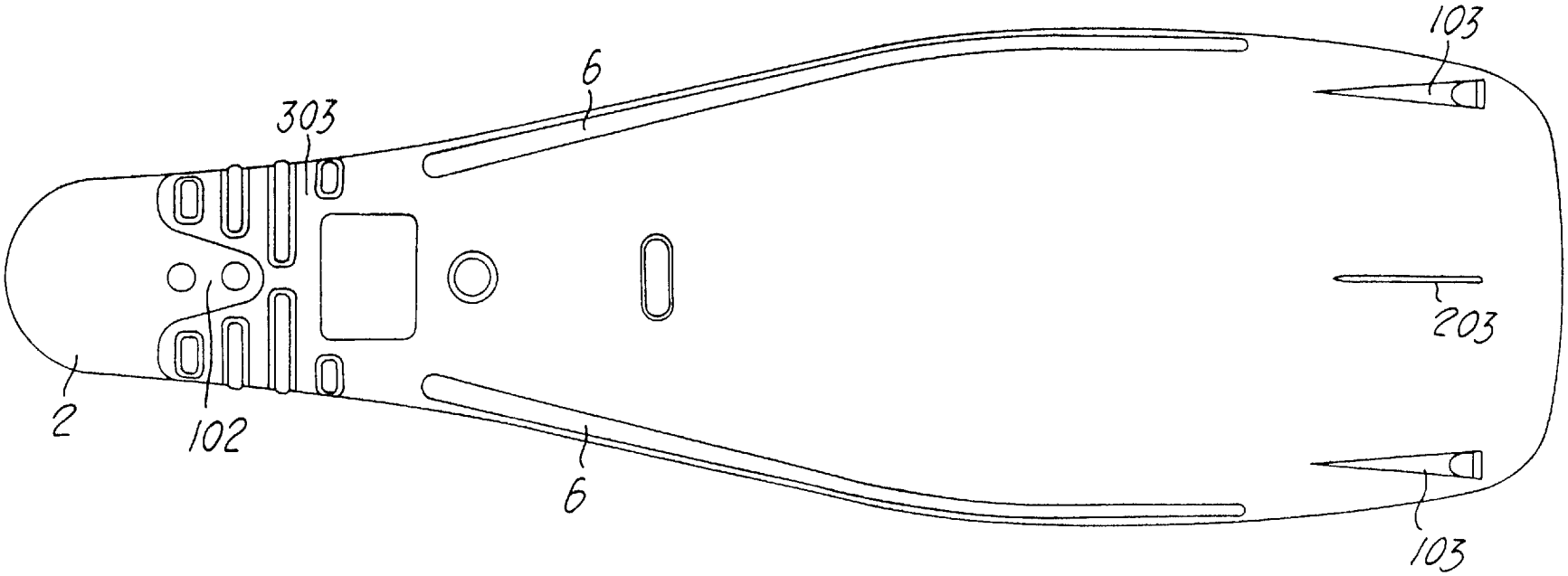
FIG. 2 is a bottom-plan view of the flipper of FIG. 1.
Figure 3:
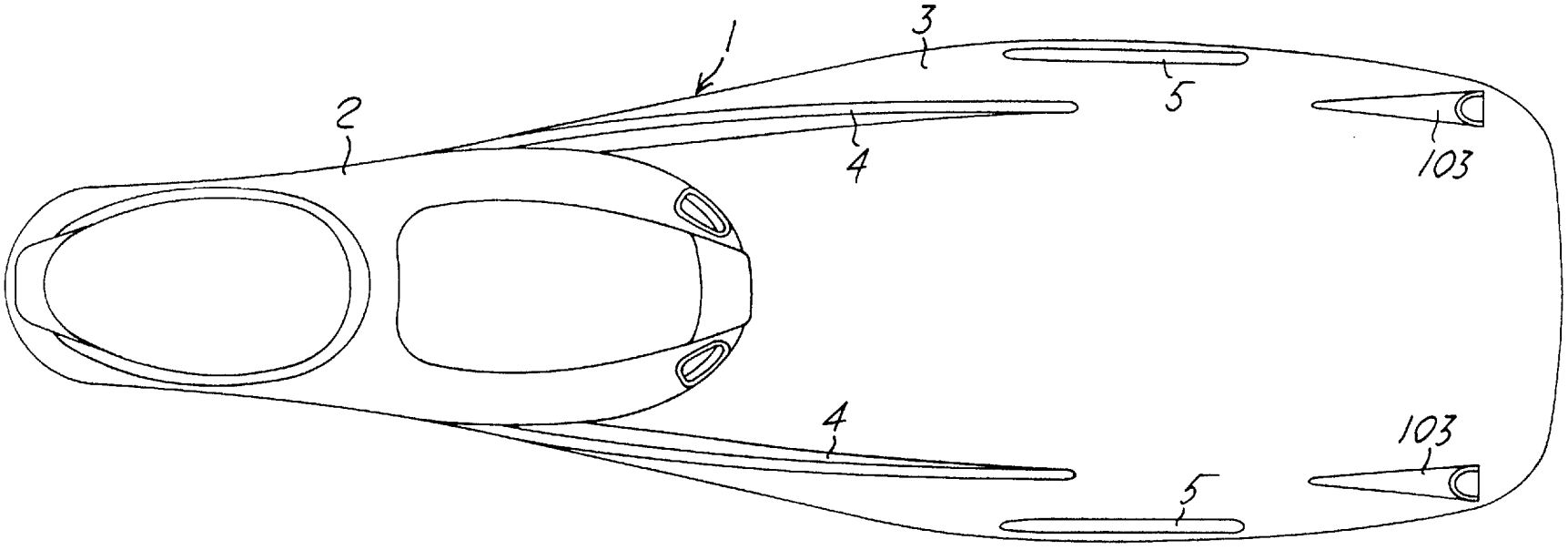
FIG. 3 is a top-plan view of the flipper of FIGS. 1 and 2.

In FIG. 2 can be seen a small drift 203, also made as one piece with the blade, which co-operates with the ribbings 4, 5, 6 and the nozzles 103 in order to convey the water flow.

The sole of the flipper is partially made up of the shoe-shaped part 2 and partially of the part 303 of the blade 3, as can be seen from FIG. 2, the connection between the two parts is gradual, since a part made of soft elastomer 102, "slips" into the stiffer part of the blade. This ensures a higher softness to the sole in its back portion.

I claim:

1. A swimming flipper comprising a blade part made from a comparatively stiff plastic material, on which a shoe-shaped part made from a comparatively soft elastomeric material is moulded, said blade part being provided with an extension extending, at least partially, below a sole portion of the shoe-shaped part, said extension being provided with two side portions extending sidewise upwards so as to surround at least partially the sides of said shoe-shaped part, said blade part being provided with projecting ribbings which are obtained during the moulding step of the shoe-shaped part by the same material as the shoe-shaped part.

2. A swimming flipper according to claim 1, in which two nozzle elements and a drift element are formed near the front rim of the said blade, said elements being formed integral with said blade.

3. A swimming flipper according to claim 2, in which said ribbings, said nozzle elements and said drift element are arranged to convey flow of water during swimming.

4. A swimming flipper according to claim 1, in which connection of said blade and said shoe-shaped part takes place gradually in the sole because of the presence of a part of said shoe shaped-part which slips into said blade.

* * * * *